US008822863B2

(12) United States Patent
Tittle

(10) Patent No.: US 8,822,863 B2
(45) Date of Patent: Sep. 2, 2014

(54) SEALED ELECTRICAL SWITCH

(75) Inventor: Michael D. Tittle, Harbor City, CA (US)

(73) Assignee: Judco Manufacturing, Inc., Harbor City, CA (US)

( * ) Notice: Subject to any disclaimer, the term of this patent is extended or adjusted under 35 U.S.C. 154(b) by 113 days.

(21) Appl. No.: 13/571,091

(22) Filed: Aug. 9, 2012

(65) Prior Publication Data

US 2013/0037397 A1 Feb. 14, 2013

Related U.S. Application Data

(60) Provisional application No. 61/522,644, filed on Aug. 11, 2011.

(51) Int. Cl.

| | |
|---|---|
| ***H01H 1/14*** | (2006.01) |
| ***H01H 13/14*** | (2006.01) |
| ***H01H 13/06*** | (2006.01) |
| *H01H 11/00* | (2006.01) |

(52) U.S. Cl.

CPC ..... *H01H 13/06* (2013.01); *H01H 2011/0081* (2013.01); *H01H 2229/046* (2013.01)

USPC ..... 200/534

(58) Field of Classification Search

USPC ..... 200/302.2, 402, 468, 520, 293, 302.1, 200/302.3, 333, 334, 345, 341

See application file for complete search history.

(56) References Cited

U.S. PATENT DOCUMENTS

| | | | | |
|---|---|---|---|---|
| 3,316,379 | A * | 4/1967 | Clarke et al. | 200/333 |
| 2005/0016826 | A1 * | 1/2005 | Li | 200/341 |
| 2006/0207868 | A1 * | 9/2006 | Wimmer et al. | 200/341 |

* cited by examiner

*Primary Examiner* — Edwin A. Leon
*Assistant Examiner* — Anthony R. Jimenez
(74) *Attorney, Agent, or Firm* — Michael Zarrabian, Esq.; Sherman & Zarrabian LLP

(57) ABSTRACT

A water resistant switch assembly comprises a sealed compartment, and an electrical switch within the compartment. The sealed compartment includes a housing defining a cavity that maintains the electrical switch therein, the housing having an upper opening and a lower opening. The sealed compartment further includes an elastomeric member sealing said upper opening, and a moldable member sealing said lower opening, whereby the electrical switch is sealed from the ambient. The elastomeric member is sufficiently flexible for moving a switch button of the switch within said cavity when the elastomeric member is pressed from outside the switch assembly.

20 Claims, 15 Drawing Sheets

SEALED ELECTRICAL SWITCH

CROSS-REFERENCE TO RELATED APPLICATION

This application claims priority benefit under 35 U.S.C. §119(e) of U.S. Provisional Patent Application Ser. No. 61/522,644 filed on Aug. 11, 2011, incorporated herein by reference.

FIELD OF THE INVENTION

The present invention is related to electrical switches, and in particular, to sealed electrical switches.

DESCRIPTION OF RELATED ART

Conventional electrical switches, such as those used in vehicles for releasing rear glass hatches or trunks, include components that are assembled together using mechanical engagement/bonding. A previous switch assembly currently used in the tailgate of sport utility vehicles for raising and lowering a window sometimes receives enough moisture to fail. The switch is located under a plastic panel outside the vehicle which partially protects it from the weather and road splash. However, sometimes enough water enters the switch assembly to cause it to fail. Such switches do not provide an effective seal against moisture. The absence of a seal allows moisture and fluids from the ambient to enter the conventional switch. As such, the switches corrode and/or fail.

BRIEF SUMMARY OF THE INVENTION

In one embodiment the present invention provides a water resistant switch assembly that comprises a sealed compartment, and an electrical switch within the compartment. The sealed compartment includes a housing defining a cavity that maintains the electrical switch therein, the housing having an upper opening and a lower opening. The sealed compartment further includes an elastomeric member sealing said upper opening, and a moldable member sealing said lower opening, whereby the electrical switch is sealed from the ambient. The elastomeric member is sufficiently flexible for moving a switch button of the switch within said cavity when the elastomeric member is pressed from outside the switch assembly.

These and other aspects and advantages of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the invention, as well as a preferred mode of use, reference should be made to the following detailed description read in conjunction with the accompanying drawings, in which.

DETAILED DESCRIPTION

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The present invention relates to sealed electrical switches. In one embodiment, the present invention provides a water resistant switch assembly that comprises a sealed compartment, and an electrical switch within the compartment. The sealed compartment includes a housing defining a cavity that maintains the electrical switch therein, the housing having an upper opening and a lower opening.

The sealed compartment further includes an elastomeric member sealing said upper opening, and a moldable member sealing said lower opening, whereby the electrical switch is sealed from the ambient. The elastomeric member is sufficiently flexible for moving a switch button of the switch within said cavity when the elastomeric member is pressed from outside the switch assembly.

Figure 1:
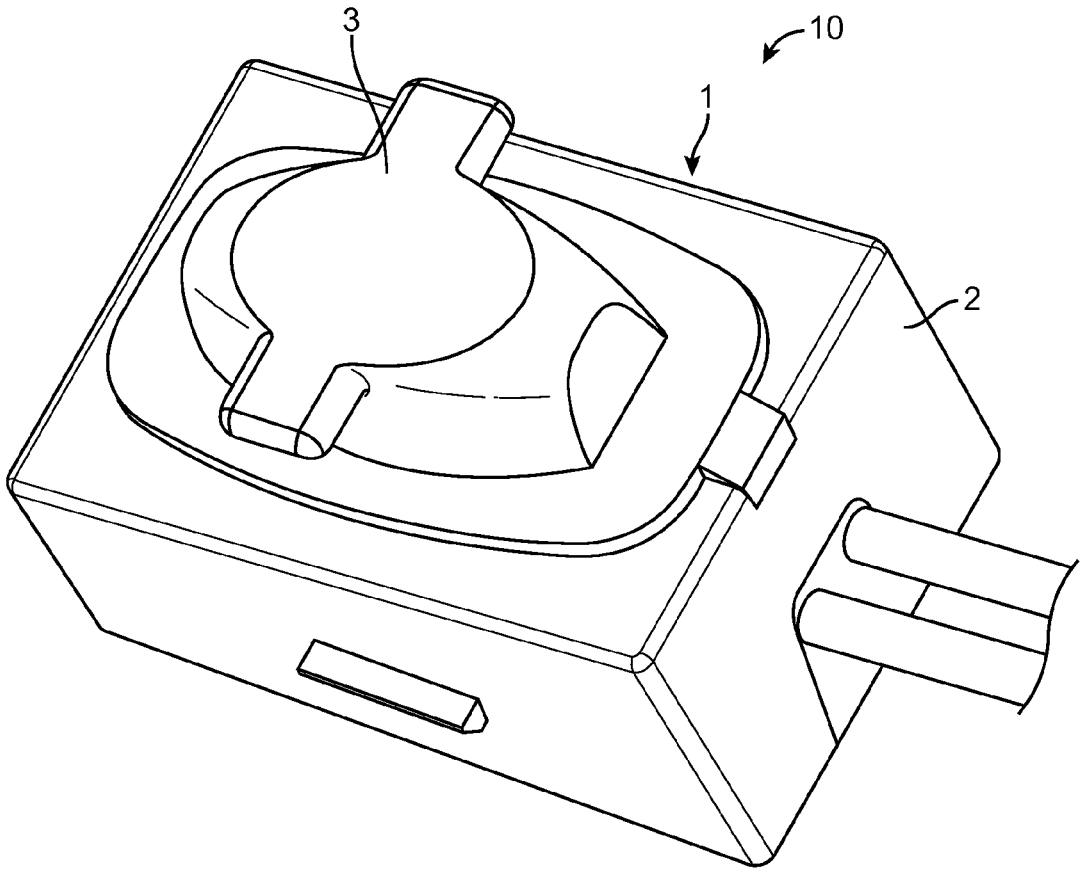
FIG. 1 illustrates a top perspective view of an embodiment of a sealed electrical switch according to an embodiment of the invention.
Figure 2:
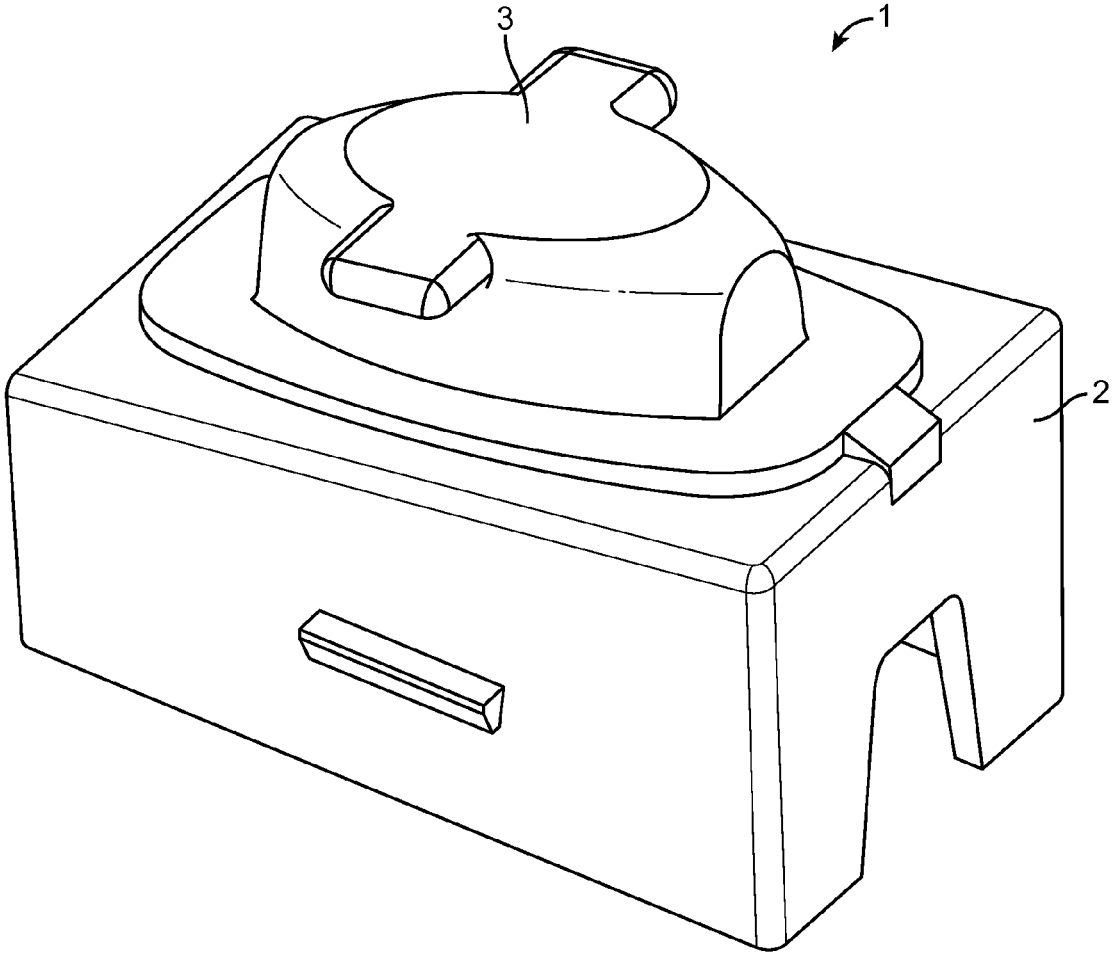
FIG. 2 illustrates another perspective view of the sealed electrical switch of FIG. 1, according to an embodiment of the invention.

FIG. 1 shows a sealed switch assembly comprising an electrical switch 10, according to an embodiment of the invention. In particular, FIG. 1 illustrates a top perspective view of an embodiment of the sealed electrical switch 10, with electrical wiring connected thereto. FIG. 2 illustrates another perspective view of an embodiment of a sealed electrical switch 10 disclosed herein, without electrical wiring connected thereto. The sealed electrical switch 10 comprises a sealed compartment 1 including a housing 2 and a rubber (or elastomeric) boot 3.

Figure 3A:
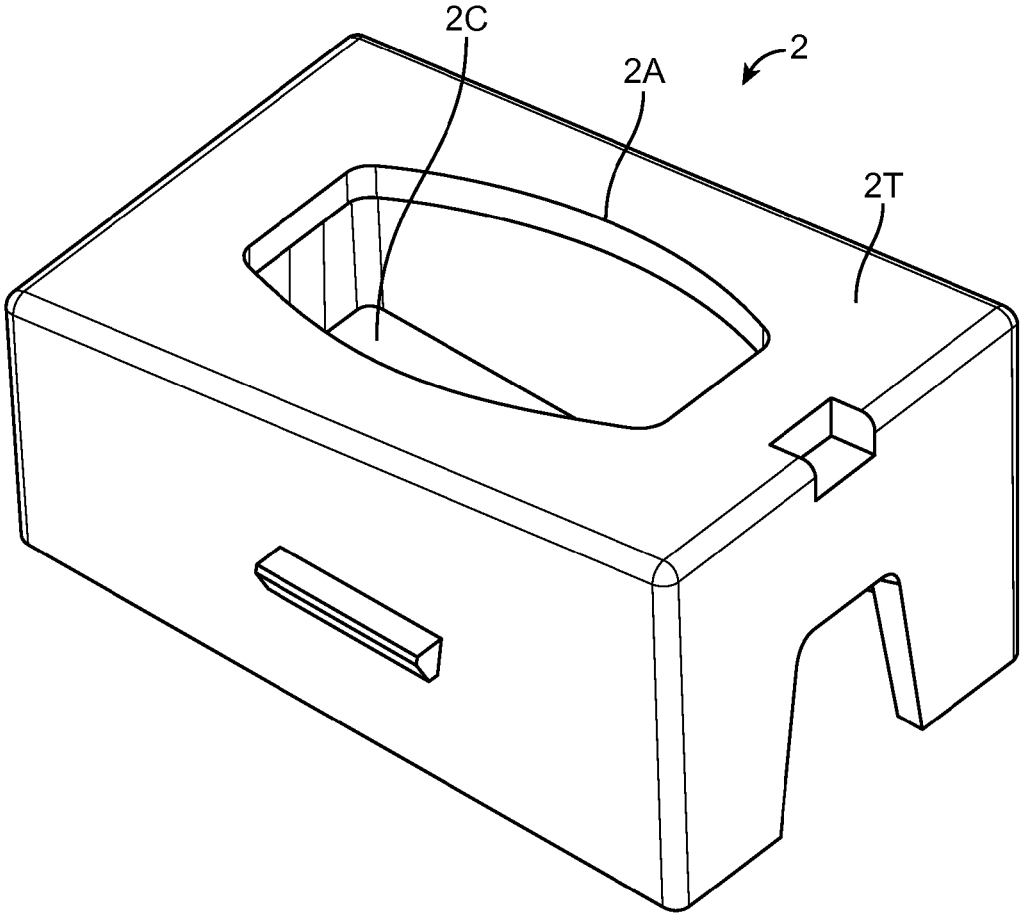
FIG. 3A shows a top perspective view of a housing of the sealed electrical switch of FIG. 1, according to an embodiment of the invention.
Figure 3B:
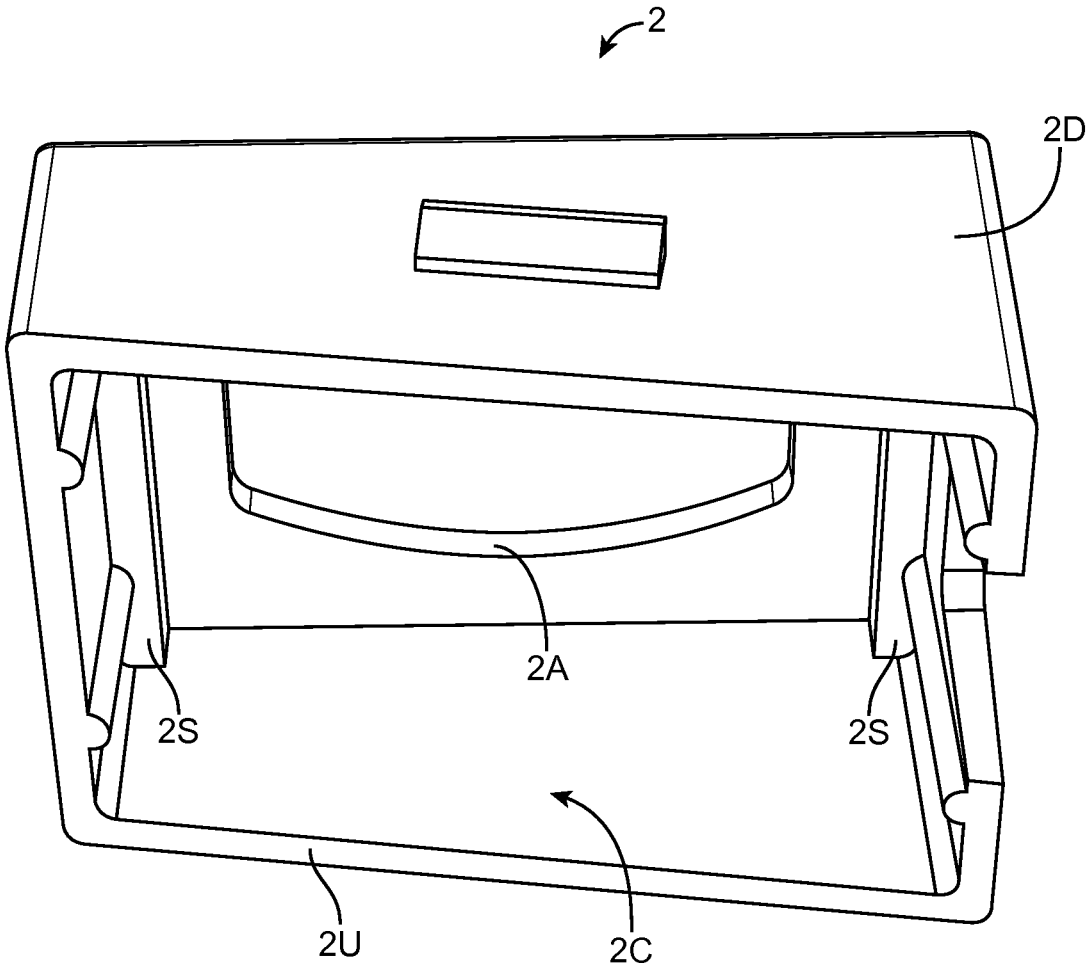
FIG. 3B shows a bottom perspective view of the housing of the sealed electrical switch of FIG. 1, according to an embodiment of the invention.

In one embodiment, housing 2 comprises essentially rectangular container. FIG. 3A shows a top perspective view of the housing 2 which includes a cavity 2C. FIG. 3B shows a bottom perspective view of the housing 2, illustrating the cavity 2C. The housing 2 comprises a top side 2T including an opening 2A, side walls 2D wherein the top side 2T and the side walls 2D form said cavity 2C in an essentially open underside 2C of the housing 2.

Figure 4A:
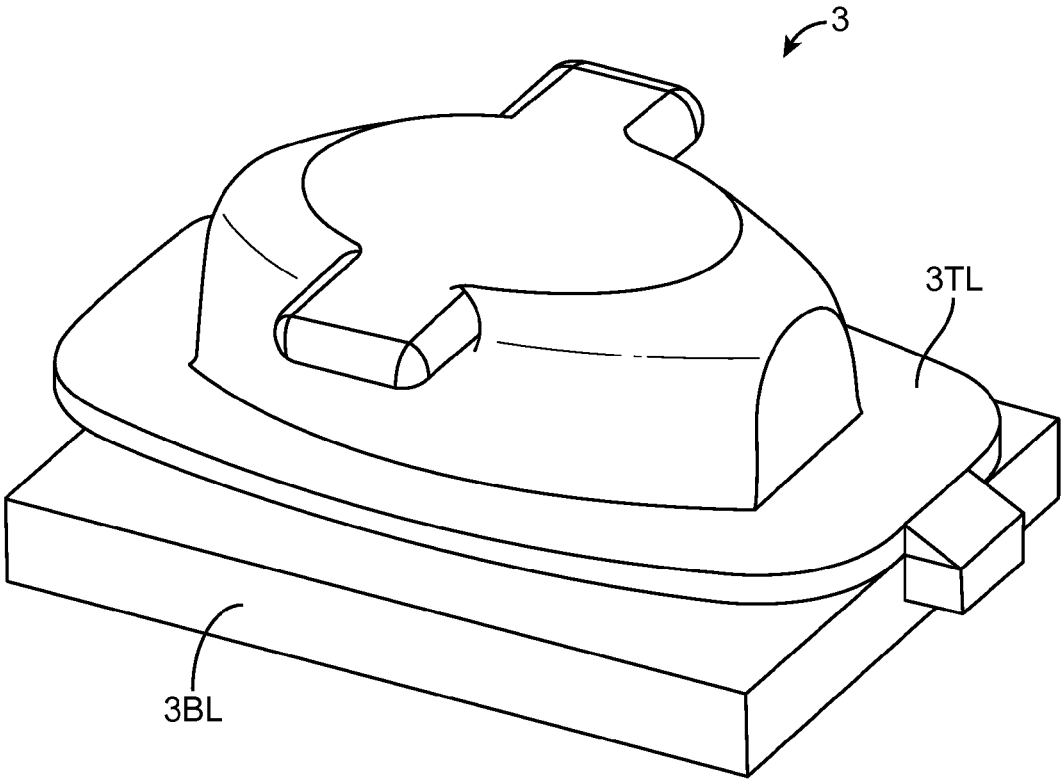
FIG. 4A illustrates a top perspective view of a rubber boot of the sealed electrical switch of FIG. 1, according to an embodiment of the invention.
Figure 4B:
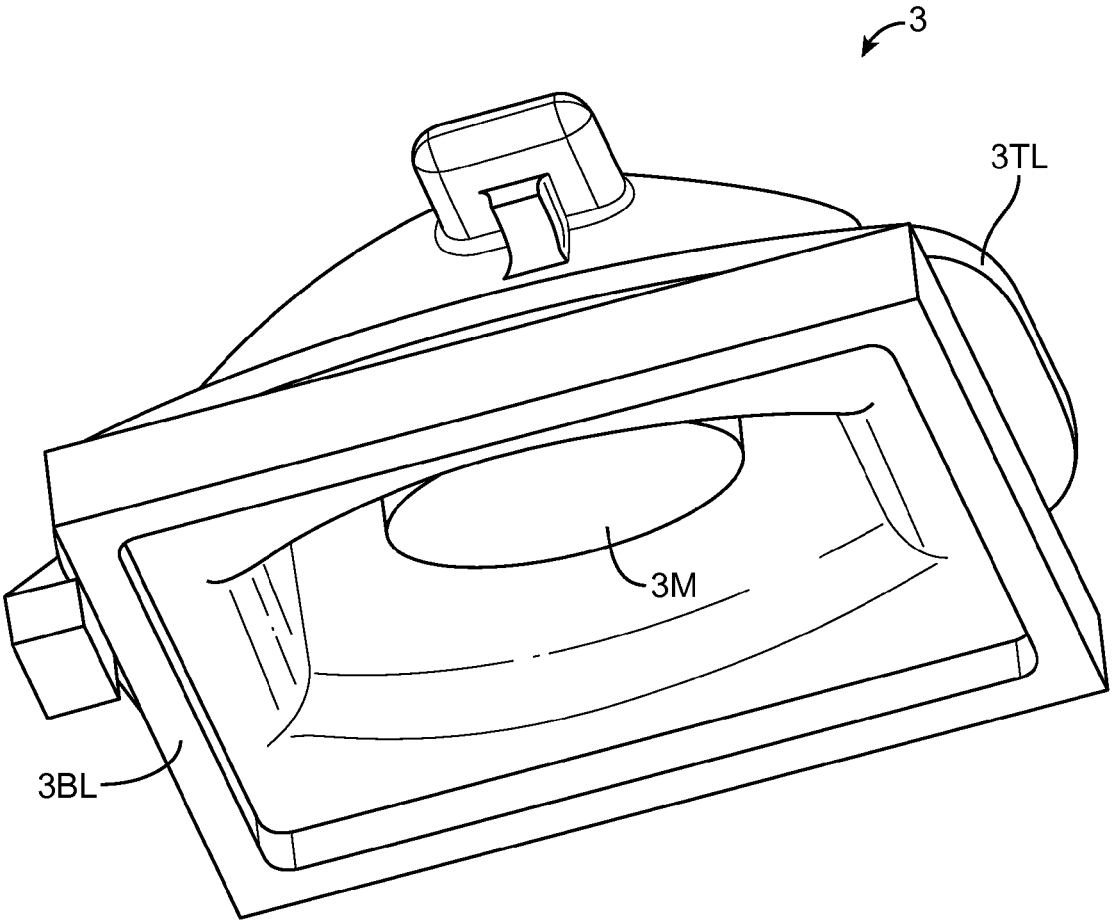
FIG. 4B illustrates a bottom perspective view of a rubber boot of the sealed electrical switch of FIG. 1, according to an embodiment of the invention.

FIG. 4A illustrates a top perspective view of the rubber boot 3 and FIG. 4B shows a bottom perspective view of the rubber boot 3. When attached to the housing 2, the rubber boot 3 forms a cohesive bond with the top side 2T of the housing 2 to cover and seal the opening 2A of the housing 2.

In one embodiment of the invention, a cohesive bond develops between the rubber boot 3 and the housing 2 through molecular attraction between like molecules in the rubber boot 3 and the housing 2. In one embodiment, the material selected for the rubber boot 3 comprises a soft touch thermoplastic elastomer (TPE). An example of such soft touch thermoplastic elastomer can be commercially obtained as Versalloy from GLS Thermoplastic Elastomers Products, PolyOne Corporation, IL 60050, USA. In one implementation, nylon is used as a bonder.

In one embodiment, the material selected for the housing 2 comprises a rigid plastic or metal. The boot 3 and the housing 2 form a hermetic seal that seals the opening 2A of the housing 2 onto the boot 3. TPEs form a cohesive bond with rigid plastic, and are generally non-corrosive. This provides increased adhesion between the housing 2 and the rubber boot 3.

In one embodiment, the rubber boot 3 forms a cohesive bond with the top side 2T of the housing 2 using an overmolding process. In one embodiment, the overmolding process comprises an injection molding process wherein one material (e.g., a TPE) is molded onto a second material (e.g., a rigid plastic) forming a cohesive bond.

In one example, injection molding comprises a process for producing parts from both thermoplastic and thermosetting plastic materials. Material is fed into a heated barrel, mixed, and forced into a mold cavity where it cools and hardens to the configuration of the cavity. Molds may be made from metal and machined to form the features of the desired part.

The material selected for the rubber boot 3 molecularly adheres to the material selected for the housing 2 during overmolding. The cohesive bond between the material selected for the rubber boot 3 and the material selected for the housing 2 creates a hermetic seal therebetween that prevents the entry of ambient moisture and fluids (e.g., rain) through the opening 2A of the housing 2. In one embodiment, said hermetic seal is impervious to air and gas.

In one embodiment the said overmolding results in the material selected for the rubber boot 3 fusing with the material selected for the housing 2. Fusing comprises combining different elements into a union. The fusing eliminates the need to use primers or adhesives for a bond between the rubber boot 3 and the housing 2.

Figure 5:
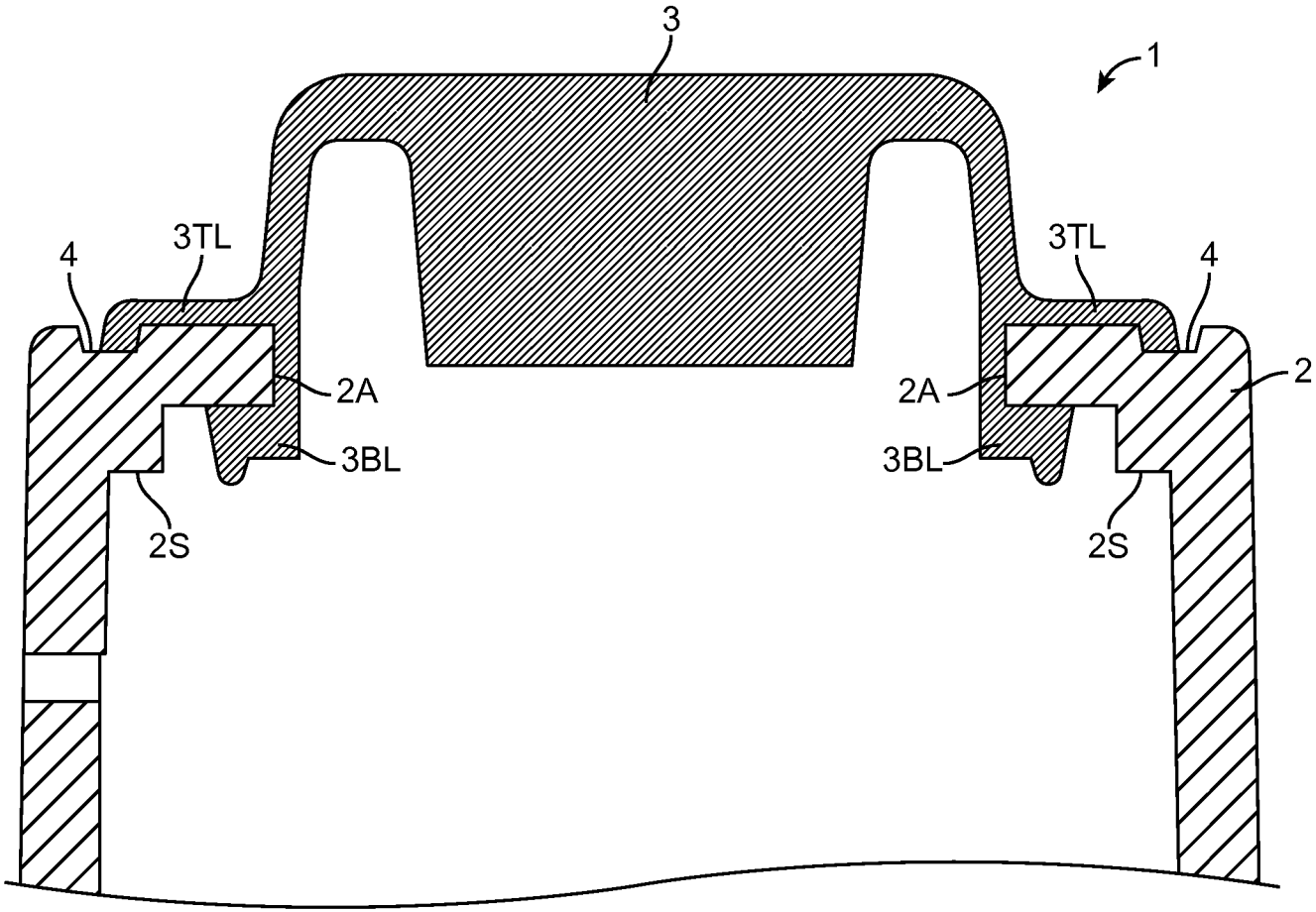
FIG. 5 illustrates a cross-sectional view of an embodiment of the housing and the rubber boot of the switch the sealed electrical switch of FIG. 1, according to an embodiment of the invention.

FIG. 5 illustrates a cross-sectional view of an embodiment of the compartment 1 showing only said housing 2 and the rubber boot 3. As shown in FIG. 5, the rubber boot 3 is molded to the contours of the opening 2A of the housing 2. The top side 2T of the housing 2 and the periphery of the boot 3 include structures for interlocking the boot 3 to the circumference of the opening 2A of the housing 2 as shown.

Specifically, in one embodiment the rubber boot 3 comprises a top peripheral lip (top flange) 3TL and a bottom peripheral lip (bottom flange) 3BL, at a base of the boot 3. The bottom peripheral lip 3BL of the boot 3 fits around a lower surface (inner surface) of the top side 2T of the housing 2 around the opening 2A, to form a seal between the boot 3 and the housing 2. Further, the top peripheral lip 3TL of the boot 3 fits around an upper surface (outer surface) of the top side 2T of the housing 2 around the opening 2A, to form a seal between the boot 3 and the housing 2.

Both the top lip 3TL and the bottom lip 3BL of the rubber boot 3 are molded around the circumference of the opening 2A of the housing 2 using overmolding to form a seal, as described herein. In one embodiment, the housing 2 includes a groove ("gate") 4. The gate 4 is the location where the material selected for the rubber boot 3 (e.g., TPE) is injected into a mold during the overmolding process.

Figure 6:
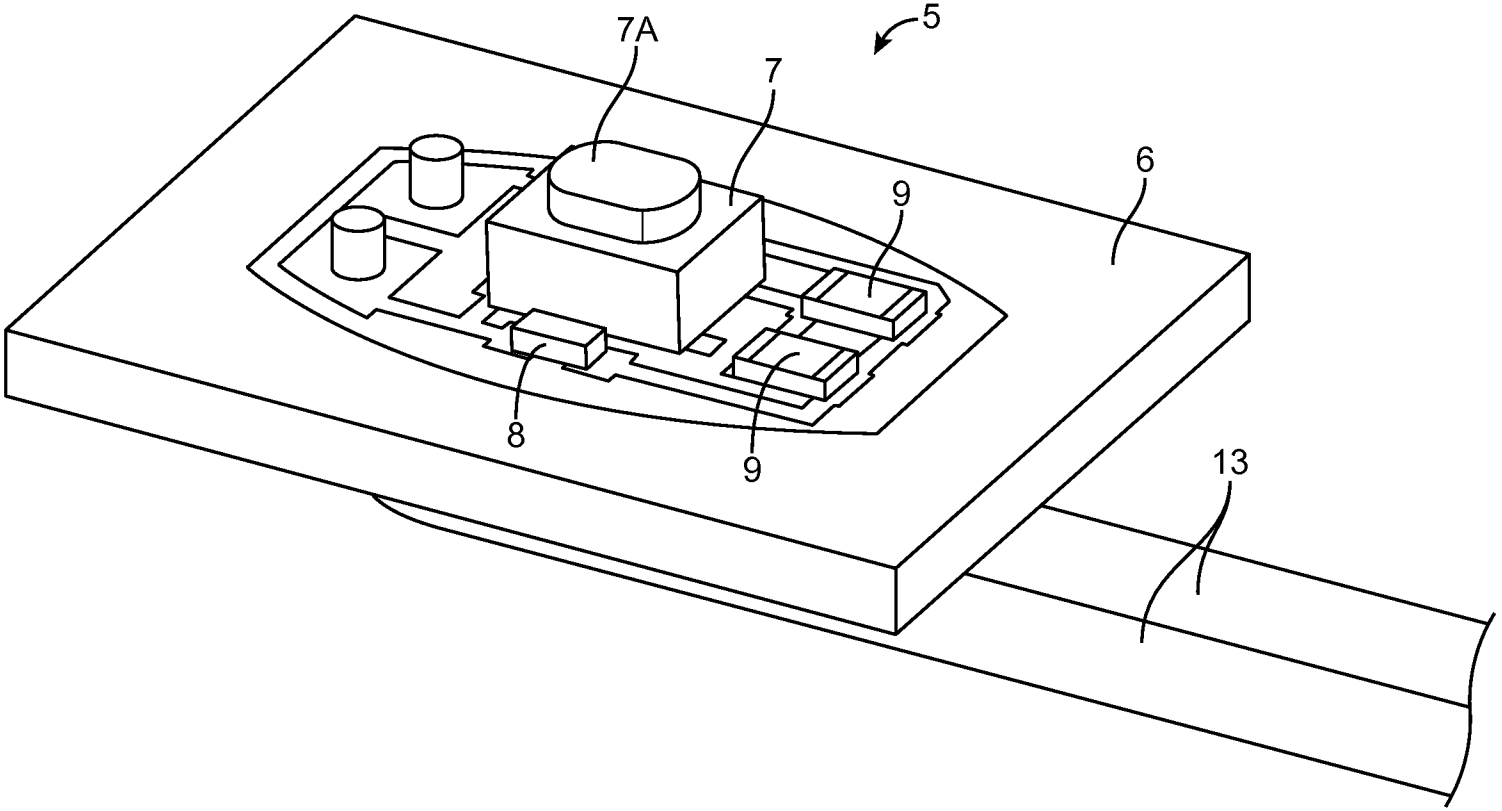
FIG. 6 illustrates a top perspective view of a circuit board including an electrical switch of the sealed electrical switch of FIG. 1, according to an embodiment of the invention.
Figure 7:
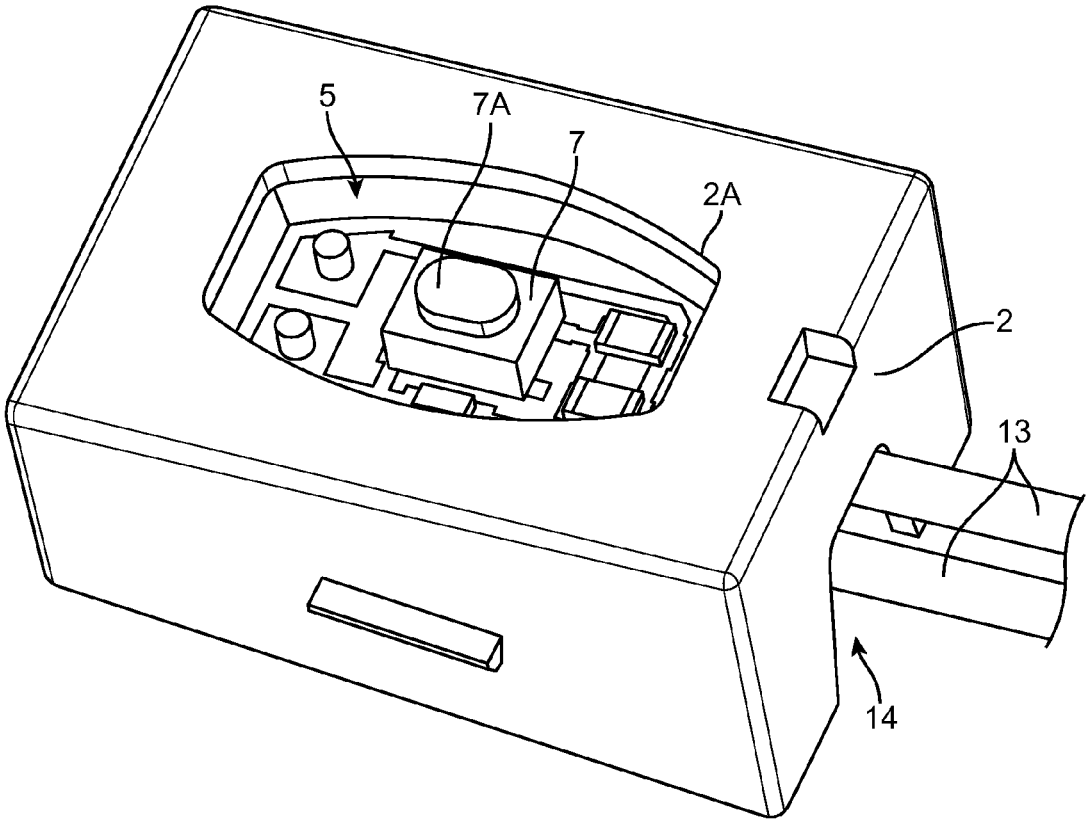
FIG. 7 shows the circuit board of FIG. 6 disposed in the housing of the sealed electrical switch of FIG. 1, according to an embodiment of the invention.

In one embodiment, a switching circuit such as a printed circuit board (PCB) sub-assembly component 5 shown in FIG. 6, is disposed in the cavity 2C of the housing 2 as shown in FIG. 7.

Specifically, FIG. 6 illustrates a perspective view of the top surface of the PCB sub-assembly component 5. In one embodiment, the PCB sub-assembly component 5 comprises a printed circuit board (PCB) 6. The PCB 6 includes a circuit populated with electric components on the top surface of the PCB 6 as shown. In one embodiment the electric components include a tactile ("tact") electrical switch 7 and may include other components such as one or more capacitors 8, resistors 9, etc.

The PCB 6 has a pair of electrical leads or wires 13 which extend out of the housing 2 when the switch 10 is assembled. These wires pass through an opening (or notch) 14 in the end of the housing 2 (FIG. 7). The wires are illustrated schematically as stubs extending from the PCB for convenience of illustration. It will be understood that the wires are of greater length sufficient for connecting to an electrical system such as an electrical system of a vehicle or the like in which the switch is used.

In one example, the switch is turned on (i.e., closes an electrical circuit) when a button 7A of the tact switch 7 is pressed down. The circuit of the PCB 6 is turned off (i.e., opens an electrical circuit) when the button 7A is released. The tact switch 7 is essentially a miniature push button switch, however, other types of switches may be used in place of a tact switch. Other example switches can be snap action switches, elastomeric keypad switches, metal dome switches, rocker switches.

FIG. 7 shows a top perspective view of the sealed electrical switch 10 housing the PCB sub-assembly component 5, with the rubber boot 3 removed for ease of illustration. The PCB sub-assembly component 5 is inserted into the cavity 2C from the open underside 2U (FIG. 3B) of the housing 2. The PCB sub-assembly component 5 is pushed inside the cavity 2C of the housing 2 until the PCB sub-assembly component 5 comes to rest against stops 2S of the housing 2 (FIGS. 3B and 5). The PCB sub-assembly component 5 is positioned directly below the opening 2A of the housing 2 as shown in FIG. 7.

Figure 8:
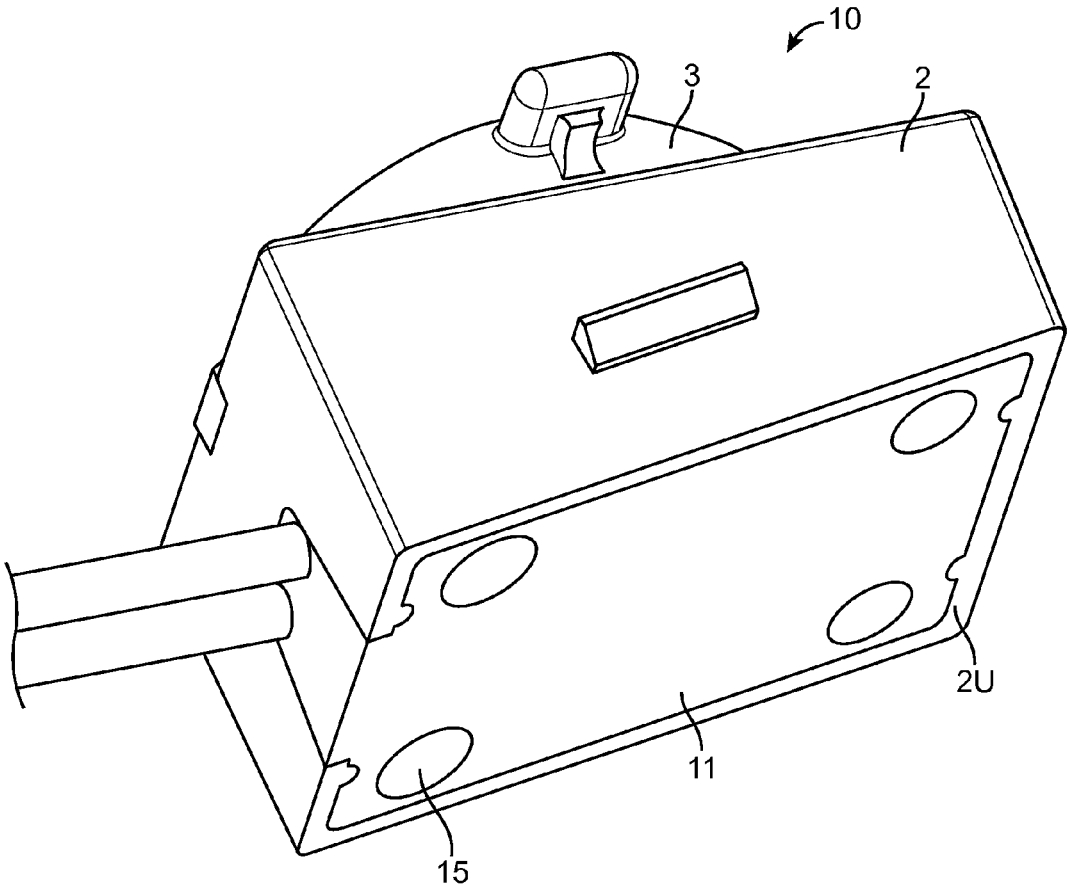
FIG. 8 shows a bottom perspective view of the sealed electrical switch of FIG. 1, according to an embodiment of the invention.

In one embodiment, after disposing the PCB sub-assembly component 5 in the cavity 2C of the housing 2, a low pressure molding material (e.g., moldable polyamide) is used to seal remaining openings of the underside 2U of the housing 2, as shown in the bottom perspective view of the switch 10 in FIG. 8. As shown in FIG. 8, the underside 2U of the housing 2 is hermetically sealed using a low pressure molding material 11 comprising e.g., moldable polymer such as moldable polyamide. An example of such moldable polymer can be commercially obtained as Macromelt from Henkel AG & Co. KGaA. The type of bonding formed between the material 11 and various members such as the housing 2, the boot 3 and the PCB 5 is an adhesive bond.

Figure 9A:
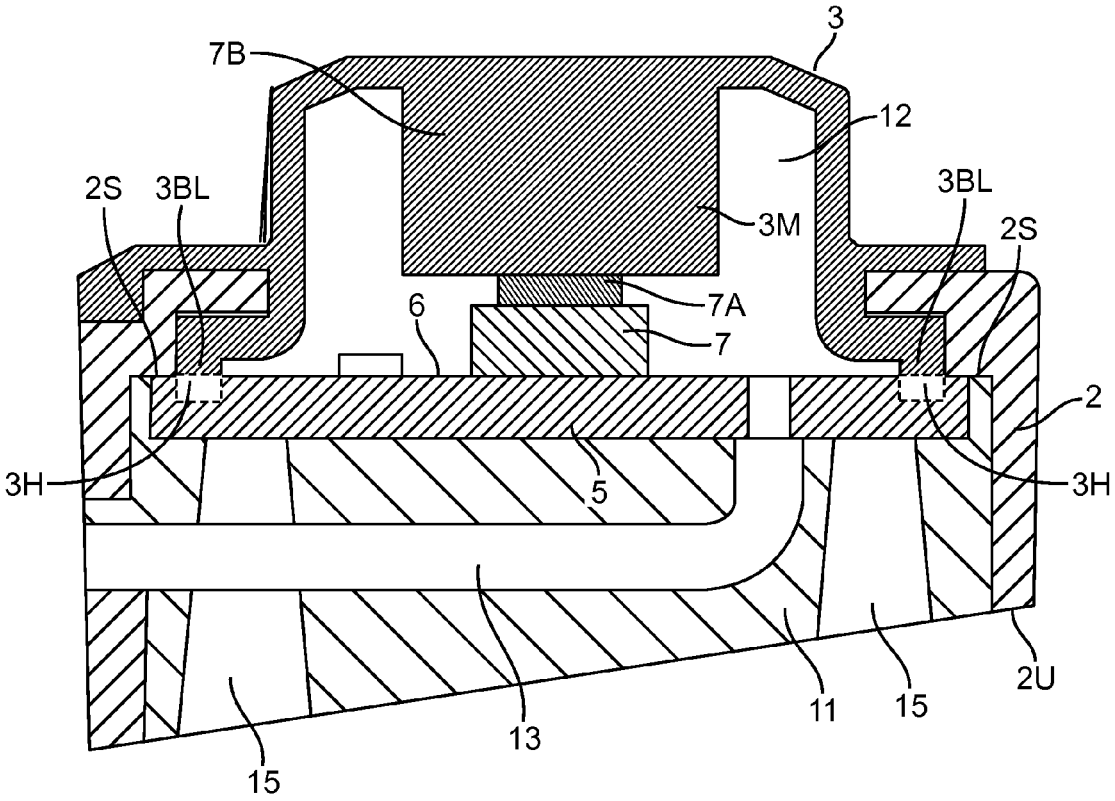
FIG. 9A shows a cross-sectional view of the sealed electrical switch of FIG. 8, according to an embodiment of the invention.
Figure 9B:
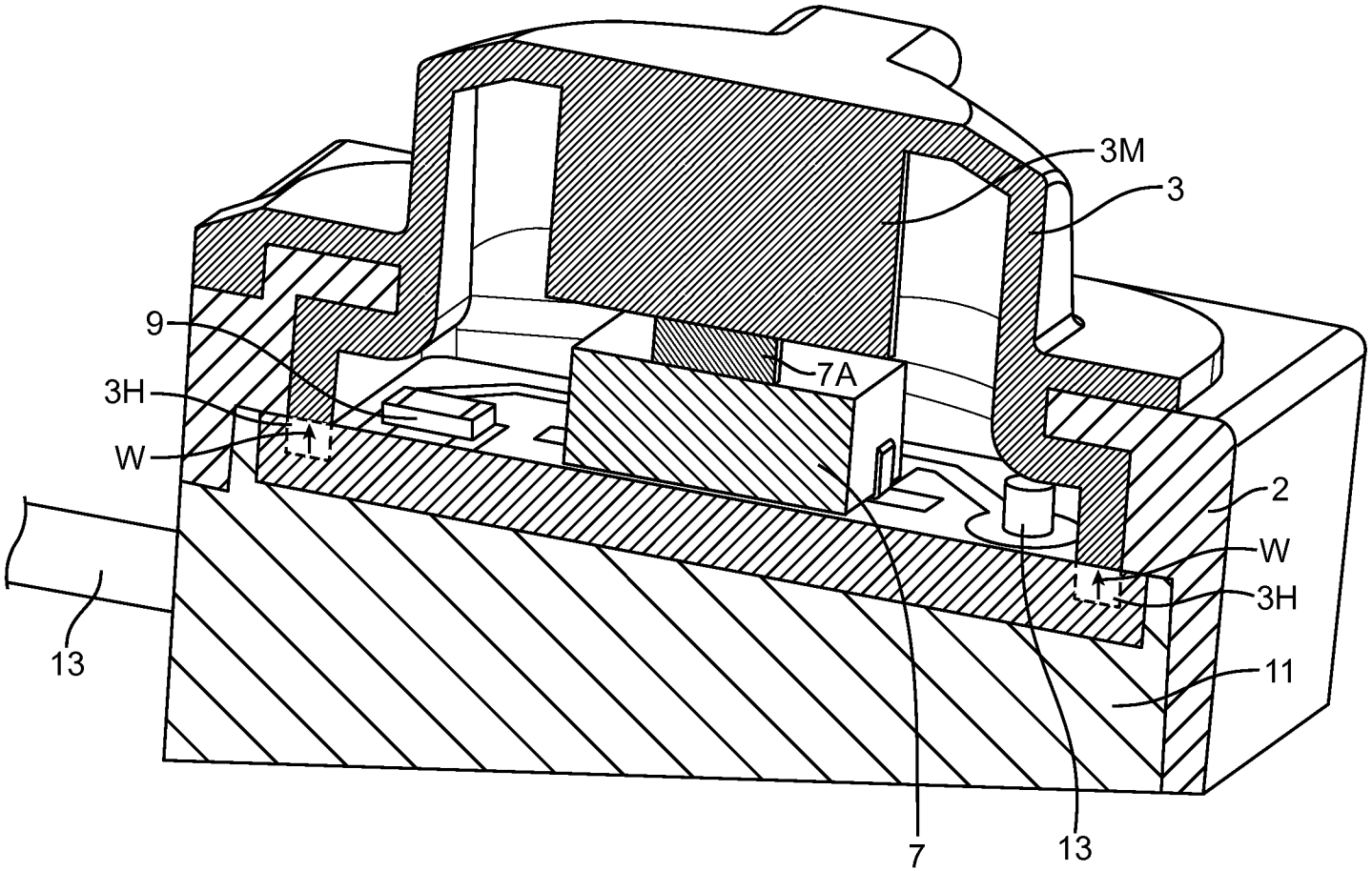
FIG. 9B shows a perspective view of a longitudinal cross-section of the sealed electrical switch of FIG. 8, according to an embodiment of the invention.
Figure 9C:
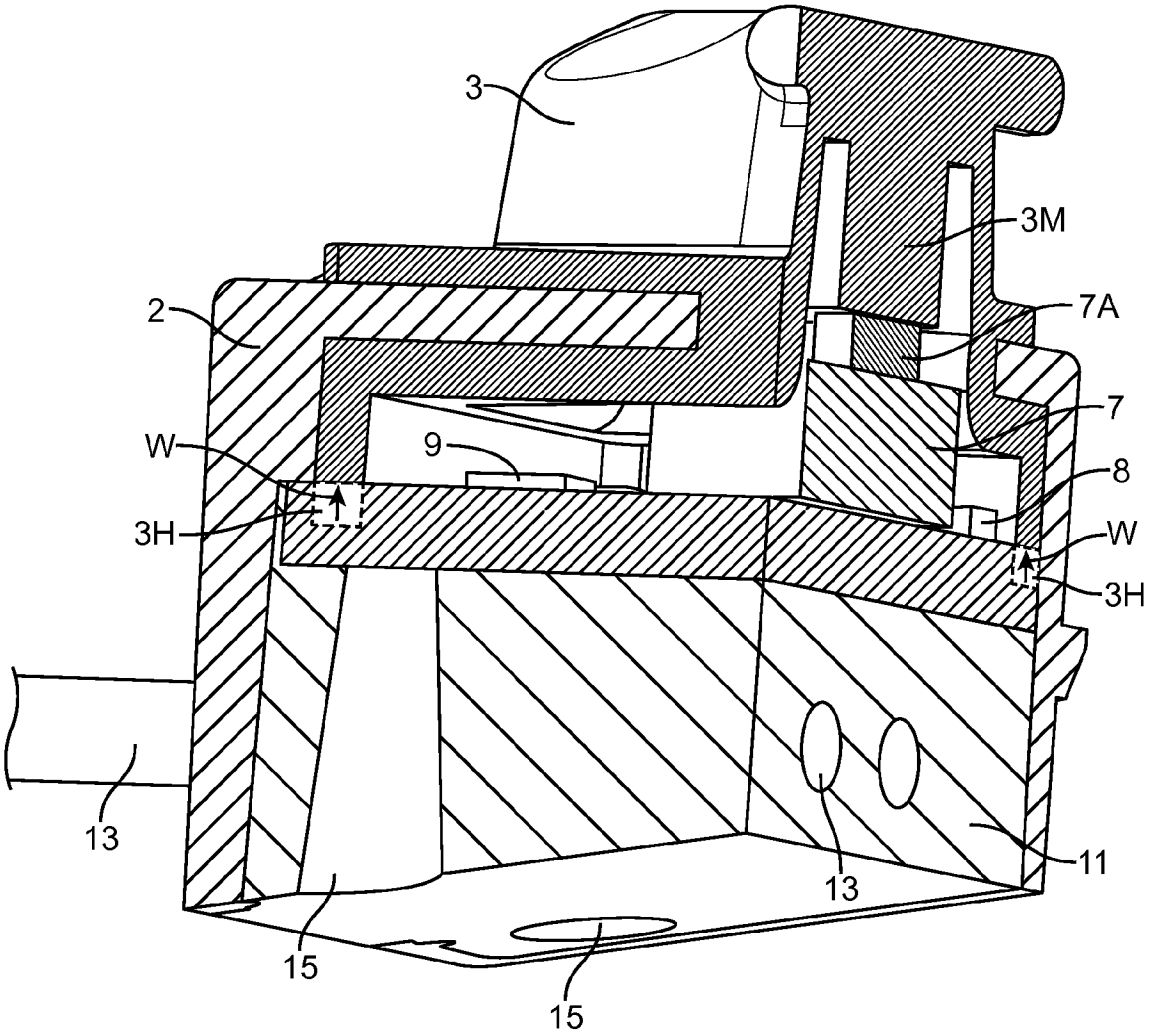
FIG. 9C shows a perspective view of another cross-section of the sealed electrical switch of FIG. 8, according to an embodiment of the invention.
Figure 9D:
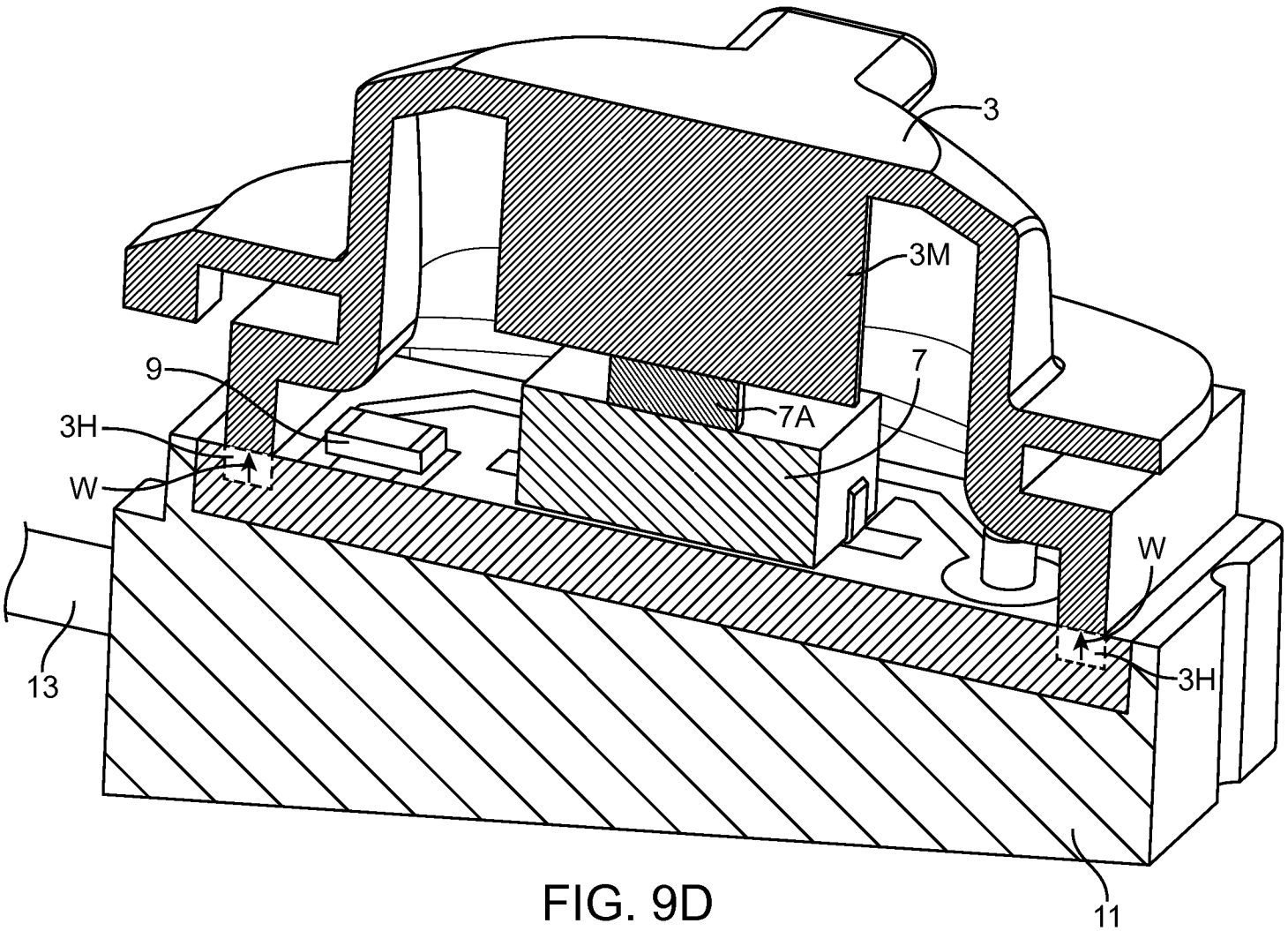
FIG. 9D shows a perspective view of another cross-section of the sealed electrical switch of FIG. 8 without the housing, according to an embodiment of the invention.

FIG. 9A illustrates a cross-sectional view of the switch 10 of FIG. 8. FIG. 9B shows a perspective view of a longitudinal cross-section of the sealed electrical switch of FIG. 8, according to an embodiment of the invention. FIG. 9C shows a perspective view of another cross-section of the sealed electrical switch of FIG. 8. Further, FIG. 9D shows a perspective view of another cross-section of the sealed electrical switch of FIG. 8 without the housing 2, according to an embodiment of the invention.

Referring to FIGS. 9A-9D, according to an embodiment of the invention, for assembling the switch 10 the PCB sub-assembly component 5 is pushed inside the cavity 2C of the housing 2 such that the PCB sub-assembly component 5 rests against the stops 2S of the housing 2 and is urged against the bottom lip 3BL of the rubber boot 3. A clearance 12 is created under a dome 7B of the rubber boot 3 when the PCB sub-assembly component 5 rests against the bottom lip 3BL of the rubber boot 3. The PCB 6 and switch 7 are maintained within the clearance 12.

The switch 7 rests underneath the dome of the rubber boot 3. Specifically, the switch 7 rests directly underneath a portion 3M of the dome of the rubber boot 3, wherein the portion 3M extends inwardly from the dome of the rubber boot 3. Pressing down on the dome of the rubber boot 3 of the sealed electrical switch 10 causes the portion 3M to press down the button 7A of the tact switch 7.

The PCB sub-assembly component 5 rests against the stops 2S in the roof of the cavity 2C proximate said opening 2A, wherein a periphery of the PCB sub-assembly component 5 is urged against the bottom lip 3BL of the rubber boot 3 by the molding material 11. Before the molding material 11 is injected into the cavity 2C of the housing 2, a portion 3H of the bottom lip 3BL extends beyond the stops 2S. The portion 3H of the bottom lip 3BL is shown in ghost (dashed) lines in FIGS. 9A-9D.

When the molding material 11 is injected into the cavity 2C of the housing 2, the molding material 11 urges the PCB sub-assembly component 5 against the bottom lip 3BL until the PCB sub-assembly component 5 rests against the stops 2S. The urging action resulting from the injection of the molding material 11 causes the periphery of the PCB sub-assembly component 5 to compress against, and deform, the portion 3H of the bottom lip 3BL to form a seal between the portion 3H and the periphery of the PCB sub-assembly component 5. This seal prevents the material 11 from entering into the cavity 12 during injection molding of the material 11 into the cavity 2C. An arrow W in FIGS. 9B-9D indicates the direction of a force as the PCB sub-assembly component 5 compresses against the portion 3H of the bottom lip 3BL. The portion 3H of the bottom lip 3BL is compressed until the PCB sub-assembly component 5 rests against the stops 2S, and the bottom lip 3BL is substantially in alignment with the stops 2S.

The stops 2S and the bottom lip 3BL form a barrier that prevents the low pressure molding material 11 from flowing into the clearance 12 and onto the electrical components and switch on the upper surface of PCB 6 when the low pressure molding material 11 is injected into the cavity 2C of the housing 2.

As also shown in FIG. 7, the PCB sub-assembly component 5 is positioned directly below the opening 2A of the housing 2. The PCB 6 is positioned directly below the opening 2A of the housing 2 in the clearance 12. There is normally a gap between the top of the switch button 7A and the lower most point of the dome of the boot 3. Pressing down on the dome of the rubber boot 3 of the sealed electrical switch 10 causes the dome of the rubber boot 3 to deflect down towards the button 7A, closing said gap, and in turn press down the button 7A of the tact switch 7. Removing pressure from the dome causes the dome to assume the normal shape, opening said gap whereby pressure button 7A is released. In one example, when the button 7A is pressed down, the normally open sealed electrical switch 10 is closed.

In one embodiment, the boot 3 has a flexible central oval dome area roughly corresponding to the shape of the opening 2A. The switch 7 is operated by pressing on the flexible dome area of the boot 3 to press the button 7A and close the normally open switch 7. The switch 7 opens again when pressure on the boot 3 is relieved, wherein button 7A spring up to close the switch 7. Thus, the entire operation of the switch 7 occurs inside the sealed portion of the switch assembly 10 so that moisture is excluded. Effectively, the flexible boot 3 seals opening 2A of the housing 2 and the material 11 seals underside 2U and wire opening 14 of the housing 2.

In the illustrated embodiment, the oval area is slightly domed, but that is only a characteristic of the specific embodiment. Other ways of securing the housing 2 and boot 3 in an embodiment similar to that illustrated, and other variations in the switch assembly will also be apparent to those skilled in the art.

The clearance 12 is displaced when the rubber boot 3 is pressed down to operate the switch 7. The cohesive bond between the rubber boot 3 and the top side 2T of the housing 2 is maintained when the rubber boot 3 is depressed, and prevents the entry of ambient moisture and fluids (e.g., rain) into the clearance 12 through the opening 2A of the housing 2. The material 11 also forms a seal around the wires 13 and opening 14 (FIG. 7) and helps maintain the wires 13 in place in relation to the housing the housing 2. The low pressure molding material 11 prevents the entry of ambient moisture and fluids into the clearance 12 through the underside 2U and the wire opening 14, of the housing 2. Thus, there are seals for all possible leak paths through the housing 2 into the clearance 12, when the switch 10 is assembled.

The compartment 1 further includes a molding material 11 to seal the underside 2U of the housing 2. To hermetically seal the underside 2U of the housing 2, the housing 2 with the PCB sub-assembly component 5 disposed therein, is placed in a mold cavity. The mold cavity has holes through which pins can be inserted to push the PCB sub-assembly component 5 inside the cavity 2C until the PCB sub-assembly component 5 rests against the stops 2S of the housing 2 and the bottom lip 3BL of the rubber boot 3 as shown in FIGS. 9A-C.

The low pressure molding material 11 (e.g., moldable polyamide) is then injected into the cavity 2C via the underside 2U of the housing 2. The low pressure molding material 11 flows upwards but is prevented from getting onto the PCB 6 of PCB sub-assembly component 5 by the stops 2S of the housing 2 and the bottom lip 3BL of the rubber boot 3. The holes of the mold cavity leave an impression in the sealed electrical switch 10, as indicated by the recessed areas 15 shown in FIGS. 9A and 9C.

The underside 2U of the housing 2 is hermetically sealed when the low pressure molding material 11 solidifies. The low pressure molding material 11 prevents ambient moisture and fluids from entering the housing 2 through the underside 2U of the housing 2. The low pressure molding material 11 also helps maintain the PCB sub-assembly component 5 in place inside the cavity 2C of the housing 2.

Figure 10A:
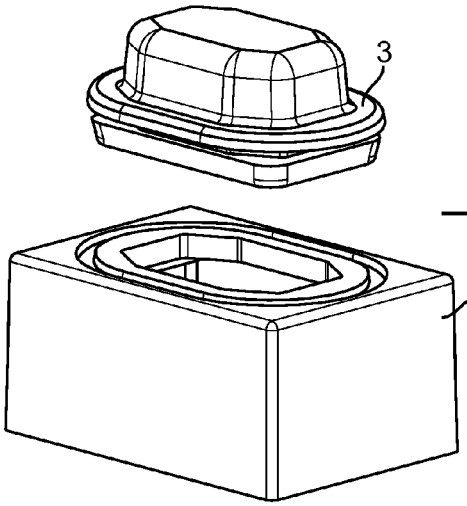
FIGS. 10A-10D illustrate a process of assembling the sealed electrical switch of FIG. 1, according to an embodiment of the invention.

FIGS. 10A-10D illustrate a process for assembling the sealed electrical switch 10, according to an embodiment of the invention. As shown in FIG. 10A, the rubber boot 3 is overmolded on the periphery of the opening 2A of the housing 2 to form the compartment 1. The cohesive bond between the rubber boot 3 and the housing 2 hermetically seals the top side 2T of the housing 2.

Figure 10B:
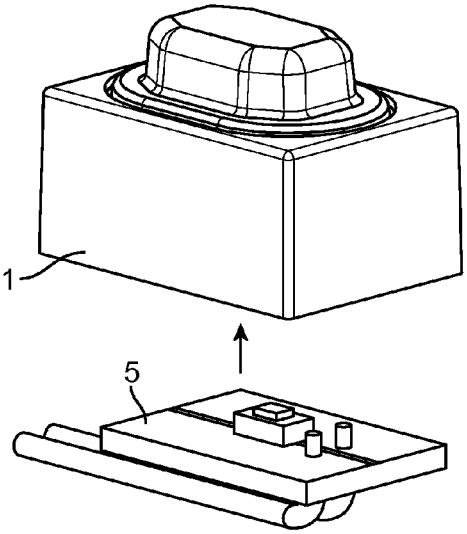
Figure 10C:
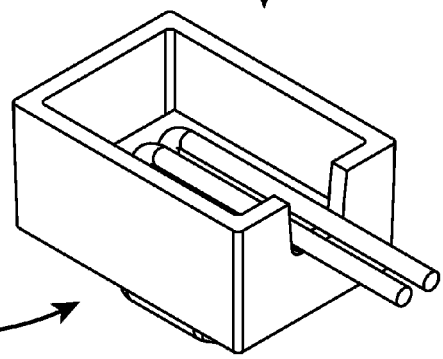
Figure 10D:
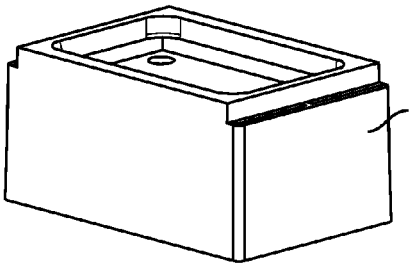

As shown in FIG. 10B, the PCB sub-assembly component 5 is inserted inside the cavity 2C of the housing 2 via the underside 2U of the housing 2 and positioned in the cavity 2C as shown in FIG. 10C. The low pressure molding material 11 is injected into the cavity 2C of the housing 2 from the underside 2U of the housing 2 onto the bottom surface of the PCB 6, urging the periphery of the PCB 6 against the lips 3BL of the boot 3 and forming a seal (FIG. 9A). FIG. 10D shows the form that the low pressure material 11 will take after being injected into the housing sub-assembly. The low pressure molding material 11 will take on whatever form the housing 2 has, thus allowing it to seal around complex shapes.

Hermetically sealing the top side of the housing 2 with the boot 3, and the underside of the housing 2 with the material 11 in such a manner, protects the PCB 6 of the PCB sub-assembly component 5 from moisture and fluids from the ambient. The sequence described herein for assembling the switch 10 is only one example of different sequences in which the switch 10 may be assembled as those skilled in the art will appreciate.

Embodiments of a sealed electrical switch disclosed herein are useful in many applications such as with door handles of vehicles, power tools, projectile-firing weapons, marine applications, etc. In one embodiment, a sealed electrical switch is used in a vehicle to release a door lock, rear glass hatch or trunk of the vehicle. In one embodiment, such a sealed electrical switch prevents ambient fluids and moisture from entering the switch.

While certain exemplary embodiments of a sealed electrical switch have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A switch assembly, comprising:

a sealed compartment; and an electrical switch within the sealed compartment;

wherein the sealed compartment includes a substantially rigid housing defining a cavity that maintains the electrical switch therein, the housing having an upper opening and a lower opening;

wherein the sealed compartment further includes an elastomeric member sealing said upper opening and forming an essentially hermetic seal therebetween, and a moldable member sealing said lower opening, whereby the electrical switch is sealed from the ambient;

wherein the elastomeric member is sufficiently flexible for moving a switch button of the switch within said cavity under elastomeric member when the elastomeric member is pressed from outside the switch assembly.

2. The switch assembly of claim 1, wherein:

the elastomeric member comprises a thermoplastic elastomer (TPE).

3. The switch assembly of claim 1, wherein:

the elastomeric member comprises a soft touch thermoplastic elastomer.

4. The switch assembly of claim 1, wherein:

the elastomeric member molecularly adheres to the housing, forming said hermetic seal therebetween.

5. The switch assembly of claim 4, wherein:

the elastomeric member molecularly adheres to the housing via an overmolding process that forms said hermetic seal between the housing and the elastomeric member.

6. The switch assembly of claim 1, wherein the moldable member comprises a moldable polyamide that hermetically seals said lower opening of the housing.

7. The switch assembly of claim 1, wherein sealed compartment is water resistant.

8. A water resistant switch assembly, comprising:

a rigid housing defining a cavity; and an electrical switch within the cavity of the housing;

wherein the housing has an upper opening and a lower opening, the upper opening being sealed with an elastomeric member forming an essentially hermetic seal therebetween, the elastomeric member comprising a thermoplastic elastomer (TPE) member, and the lower opening being sealed with a moldable member, such that the electrical switch is sealed from the ambient; and wherein the elastomeric member is sufficiently flexible for moving a switch button of the switch within said cavity under elastomeric member when the elastomeric member is pressed from outside the switch assembly.

9. The switch assembly of claim 8, wherein:

the thermoplastic elastomer member comprises a soft touch thermoplastic elastomer member.

10. The switch assembly of claim 9, wherein:

the thermoplastic elastomer member molecularly adheres to the housing, forming said hermetic seal therebetween.

11. The switch assembly of claim 10, wherein:

the thermoplastic elastomer member molecularly adheres to the housing via an overmolding process that forms said hermetic seal between the housing and the thermoplastic elastomer member.

12. The switch assembly of claim 11, wherein the moldable member comprises a moldable polyamide that hermetically seals said lower opening of the housing.

13. The switch assembly of claim 8, wherein the elastomeric member comprises a boot member having a dome portion for moving the switch button of the switch within said cavity under the dome as the dome is pressed from outside the switch assembly.

14. The switch assembly of claim 13, wherein:

the boot member includes a top flange and a bottom flange at a base of the boot member; and the bottom flange fits around a lower surface of said upper opening and the top flange fits around an upper surface of said upper opening, to form a seal between the boot member and the housing.

15. The switch assembly of claim 14, wherein the housing is rectangular.

16. A water resistant switch assembly, comprising:

a rigid housing a cavity; and an electrical switch circuit within the cavity of the housing;

wherein the housing has an upper opening and a lower opening, the upper opening being sealed with a boot member comprising a thermoplastic elastomer (TPE) that molecularly adheres to the housing forming a hermetic seal therebetween, and the lower opening being sealed with a moldable member, such that the electrical switch circuit is hermetically sealed from the ambient;

wherein the boot member is sufficiently flexible for moving a switch button of the electrical switch circuit within said cavity under the boot member when the boot member is pressed from outside the switch assembly.

17. The switch assembly of claim 16, wherein:

the moldable member comprises a moldable polyamide that hermetically seals said lower opening of the housing; and the boot member molecularly adheres to the housing via an overmolding process that forms said hermetic seal between the housing and the boot member.

18. The switch assembly of claim 17, wherein:

the boot member has a dome portion for moving the switch button of the switch within said cavity under the dome as the dome is pressed from outside the switch assembly; and the boot member includes a top flange and a bottom flange at a base of the boot member, wherein the bottom flange fits around a lower surface of said upper opening and the top flange fits around an upper surface of said upper opening, to form a seal between the boot member and the housing.

19. The switch assembly of claim 18, wherein:

the housing further includes stops in a roof of said cavity proximate said upper opening of the housing; and the electrical switch circuit comprises an essentially planar PCB, such that a periphery of the PCB rest against said stops, and is urged against said bottom flange of the boot member by the moldable member.

20. The switch assembly of claim 19, wherein:

the housing further includes wire openings for connecting electrical wires to the electrical switch circuit from exterior of the housing, wherein the moldable member further seals around the wires and seals the wire openings from the ambient.

* * * * *